US010121423B2

(12) United States Patent
Yeo et al.

(10) Patent No.: US 10,121,423 B2
(45) Date of Patent: Nov. 6, 2018

(54) DISPLAY PANEL DRIVING APPARATUS AND METHOD WITH OVER-DRIVING OF FIRST AND SECOND IMAGE DATA

(71) Applicant: SAMSUNG DISPLAY CO., LTD., Yongin-si, Gyeonggi-Do (KR)

(72) Inventors: Jang-Hyun Yeo, Seoul (KR); Po-Yun Park, Seoul (KR); Dong-Won Park, Hwaseong-si (KR); Jung-Hwan Cho, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 94 days.

(21) Appl. No.: 15/041,778

(22) Filed: Feb. 11, 2016

(65) Prior Publication Data

US 2017/0084235 A1 Mar. 23, 2017

(30) Foreign Application Priority Data

Sep. 22, 2015 (KR) ..... 10-2015-0133867

(51) Int. Cl.
*G09G 3/36* (2006.01)
*G09G 5/06* (2006.01)
*G09G 5/10* (2006.01)

(52) U.S. Cl.
CPC ... *G09G 3/3607* (2013.01); *G09G 2310/0251* (2013.01)

(58) Field of Classification Search
CPC ..... G09G 3/3607; G09G 2310/0251
See application file for complete search history.

(56) References Cited

U.S. PATENT DOCUMENTS 8,605,071 B2 * 12/2013 Chen ..... G09G 3/36 345/211
2002/0140661 A1 * 10/2002 Miyajima ..... G09G 3/3648 345/96
2007/0252795 A1 * 11/2007 Shiomi ..... G09G 3/2048 345/87
2009/0009508 A1 * 1/2009 Koo ..... H04N 13/0454 345/214
2010/0118128 A1 * 5/2010 Choi ..... H04N 13/0438 348/53

(Continued)

FOREIGN PATENT DOCUMENTS

KR 1020060000624 1/2006
KR 1020080049543 6/2008
KR 1020140013196 2/2014

*Primary Examiner* — Kwang-Su Yang
(74) *Attorney, Agent, or Firm* — F. Chau & Associates, LLC

(57) ABSTRACT

A display panel driving apparatus includes an over-driving part, where the over-driving part is configured to receive first image data, and to output second image data using first over-driving data and second over-driving data, the first over-driving data is generated according to previous frame data and present frame data for a minimum blank period between the previous frame data and the present frame data of the first image data, the second over-driving data is generated according to the previous frame data and the present frame data for a maximum blank period between the previous frame data and the present frame data of the first image data, and a high display quality of a display apparatus may be achieved.

20 Claims, 8 Drawing Sheets

(56) References Cited

U.S. PATENT DOCUMENTS

2011/0090321 A1* 4/2011 Nakagawa ..... G09G 3/003
348/51
2011/0285697 A1* 11/2011 Lee ..... G06F 1/324
345/419

* cited by examiner

FIG. 3

221

| | | F(N-1) | | | | | | | |
|---|---|---|---|---|---|---|---|---|---|
| | | 0 | 16 | 32 | 48 | 64 | 80 | 96 | 112 |
| F(N) | 0 | 0 | 0 | 0 | 0 | 0 | 0 | 0 | 0 |
| | 16 | 82 | 16 | 6 | 4 | 2 | 0 | 0 | 0 |
| | 32 | 134 | 104 | 32 | 14 | 12 | 8 | 4 | 0 |
| | 48 | 170 | 144 | 122 | 48 | 22 | 18 | 16 | 14 |
| | 64 | 182 | 160 | 138 | 116 | 64 | 48 | 40 | 30 |
| | 80 | 194 | 174 | 156 | 134 | 116 | 80 | 56 | 48 |
| | 96 | 206 | 186 | 168 | 152 | 140 | 130 | 96 | 66 |
| | 112 | 214 | 196 | 182 | 170 | 155 | 150 | 144 | 112 |

FIG. 4

231

| | | F(N-1) | | | | | | | |
|---|---|---|---|---|---|---|---|---|---|
| | | 0 | 16 | 32 | 48 | 64 | 80 | 96 | 112 |
| F(N) | 0 | 0 | 0 | 0 | 0 | 0 | 0 | 0 | 0 |
| | 16 | 20 | 16 | 12 | 8 | 6 | 4 | 2 | 0 |
| | 32 | 54 | 42 | 32 | 24 | 20 | 14 | 12 | 8 |
| | 48 | 82 | 54 | 70 | 48 | 36 | 28 | 22 | 18 |
| | 64 | 134 | 104 | 70 | 98 | 64 | 58 | 52 | 48 |
| | 80 | 170 | 144 | 122 | 116 | 94 | 80 | 72 | 66 |
| | 96 | 182 | 160 | 138 | 116 | 94 | 106 | 96 | 80 |
| | 112 | 194 | 174 | 156 | 134 | 116 | 106 | 120 | 112 |

FIG. 8

341

| | | F(N-1) | | | | | | | |
|---|---|---|---|---|---|---|---|---|---|
| | | 0 | 16 | 32 | 48 | 64 | 80 | 96 | 112 |
| F(N) | 0 | 0 | 0 | 0 | 0 | 0 | 0 | 0 | 0 |
| | 16 | 32 | 16 | 8 | 6 | 4 | 2 | 0 | 0 |
| | 32 | 82 | 54 | 32 | 20 | 14 | 12 | 8 | 4 |
| | 48 | 134 | 104 | 70 | 48 | 28 | 22 | 18 | 16 |
| | 64 | 170 | 144 | 122 | 98 | 64 | 56 | 48 | 40 |
| | 80 | 182 | 160 | 138 | 116 | 94 | 80 | 66 | 56 |
| | 96 | 194 | 174 | 156 | 134 | 116 | 106 | 96 | 80 |
| | 112 | 206 | 186 | 168 | 152 | 140 | 130 | 120 | 112 |

DISPLAY PANEL DRIVING APPARATUS AND METHOD WITH OVER-DRIVING OF FIRST AND SECOND IMAGE DATA

CROSS-REFERENCE TO RELATED APPLICATION

This application claims priority under 35 U.S.C. § 119 to Korean Patent Application No. 10-2015-0133867, filed on Sep. 22, 2015 in the Korean Intellectual Property Office (KIPO), the contents of which are herein incorporated by reference in their entireties.

TECHNICAL FIELD

Exemplary embodiments of the present inventive concept relate to a display panel driving apparatus, a method of driving a display panel using the display panel driving apparatus, and a display apparatus having the display panel driving apparatus. More particularly, exemplary embodiments of the present inventive concept relate to a display panel driving apparatus driving a display panel in an over-driving method, a method of driving a display panel using the display panel driving apparatus, and a display apparatus having the display panel driving apparatus.

DISCUSSION OF RELATED ART

A liquid crystal display panel of a liquid crystal display apparatus includes a lower substrate, an upper substrate, and a liquid crystal layer interposed between the lower substrate and the upper substrate.

The lower substrate includes a first base substrate, a gate line and a data line formed on the first base substrate, a switching element electrically connected to the gate line and the data line, and a pixel electrode electrically connected to the switching element.

The upper substrate includes a second base substrate facing the first substrate, a color filter formed on the second base substrate, and a common electrode formed on the color filter.

The liquid crystal layer includes a liquid crystal of which an arrangement is changed according to an electric field due to a pixel voltage applied to the pixel electrode and a common voltage applied to the common electrode.

In order to increase response speed of the liquid crystal, the liquid crystal display panel may be driven with a Dynamic Capacitance Compensation (DCC) method according to previous frame data and present frame data.

SUMMARY

Exemplary embodiments of the present inventive concept provide a display panel driving apparatus capable of providing high display quality for a display apparatus.

Exemplary embodiments of the present inventive concept also provide a method of driving a display panel using the above-mentioned display panel driving apparatus.

Exemplary embodiments of the present inventive concept also provide a display apparatus having the above-mentioned display panel driving apparatus.

According to an exemplary embodiment of the present inventive concept, a display panel driving apparatus includes an over-driving part, a data driving part and a gate driving part. The over-driving part is configured to receive first image data, and to output second image data using first over-driving data and second over-driving data. The first over-driving data is generated according to previous frame data and present frame data in a minimum vertical blank period between the previous frame data and the present frame data of the first frame data. The second over-driving data is generated according to the previous frame data and the present frame data in a maximum vertical blank period between the previous frame data and the present frame data of the first frame data. The data driving part is configured to output a data signal based on the second image data to a data line of a display panel. The gate driving part is configured to output a gate signal to a gate line of the display panel.

In an exemplary embodiment, the over-driving part may include a first memory configured to store the first over-driving data according to the previous frame data and the present frame data in the minimum vertical blank period, and a second memory configured to store the second over-driving data according to the previous frame data and the present frame data in the maximum vertical blank period.

In an exemplary embodiment, the first memory may include a first look-up table storing a first grayscale value according to the previous frame data and the present frame data in the minimum vertical blank period, and the second memory may include a second look-up table storing a second grayscale value according to the previous frame data and the present frame data in the maximum vertical blank period.

In an exemplary embodiment, the first grayscale value according to the previous frame data and the present frame data in the minimum vertical blank period may be greater than the second grayscale value according to the previous frame data and the present frame data in the maximum vertical blank period.

In an exemplary embodiment, the over-driving part may further include an over-driver configured to output the second image data using the first over-driving data and the second over-driving data according to a vertical blank period between the previous frame data and the present frame data.

In an exemplary embodiment, when the vertical blank period corresponds to the minimum vertical blank period, the over-driver may output the second image data using the first over-driving data.

In an exemplary embodiment, when the vertical blank period corresponds to the maximum vertical blank period, the over-driver may output the second image data using the second over-driving data.

In an exemplary embodiment, when the vertical blank period corresponds to a period between the minimum vertical blank period and the maximum vertical blank period, the over-driver may output the second image data using the first over-driving data and the second over-driving data.

In an exemplary embodiment, the over-driver may output the second image data in an interpolation method.

In an exemplary embodiment, the second image data may be calculated by an equation 'ODD1+((ODD2−ODD1)*(MIN+VB)/MAX))' ('ODD1' is a first grayscale value of the first over-driving data, 'ODD2' is a second grayscale value of the second over-driving data, 'MIN' is the number of a line corresponding to the minimum vertical blank period, 'MAX' is the number of a line corresponding to the maximum blank period, and 'VB' is the number of a line corresponding to the vertical blank period).

In an exemplary embodiment, the over-driving part may output the second image data using third over-driving data in a normal vertical blank between the minimum vertical blank period and the maximum vertical blank period.

In an exemplary embodiment, the over-driving part may further include a third memory storing the third over-driving data according to the previous frame data and the present frame data in the normal vertical blank period.

In an exemplary embodiment, the third memory may include a third look-up table storing a third grayscale value according to the previous frame data and the present frame data in the normal vertical blank period.

In an exemplary embodiment, the over-driving part may further include an over-driver outputting the second image data using the first over-driving data, the second over-driving data and the third over-driving data according to a vertical blank period between the previous frame data and the present frame data.

In an exemplary embodiment, when the vertical blank period corresponds to the normal vertical blank period, the over-driver may output the second image data using the third over-driving data, when the vertical blank period corresponds to a period between the minimum vertical blank period and the normal vertical blank period, the over-driver may output the second image data using the first over-driving data and the third over-driving data, and when the vertical blank period corresponds to a period between the maximum vertical blank period and the normal vertical blank period, the over-driver may output the second image data using the second over-driving data and the third over-driving data.

In an exemplary embodiment, when a vertical blank period between the previous frame data and the present frame data is less than the minimum vertical blank period, the over-driving part may output the second image data using the first over-driving data, and when the vertical blank period between the previous frame data and the present frame data is greater than the maximum vertical blank period, the over-driving part may output the second image data using the second over-driving data.

In an exemplary embodiment, when a vertical blank period between the previous frame data and the present frame data is less than the minimum vertical blank period, the over-driving part may output the first image data as the second image data, and when the vertical blank period between the previous frame data and the present frame data is greater than the maximum vertical blank period, the over-driving part may output the first image data as the second image data.

In an exemplary embodiment, a vertical blank counter is configured to determine a vertical blank period between the previous frame data and the present frame data, wherein the vertical blank counter may recognize, blank or ignore non-display data corresponding to the vertical blank period.

According to an exemplary embodiment of the present inventive concept, a method of driving a display panel includes receiving previous frame data and present frame data of first image data, outputting second image data using first over-driving data and second over-driving data, outputting a data signal based on the second image data to a data line of the display panel, and outputting a gate signal to a gate line of the display panel. The first over-driving data is generated according to previous frame data and present frame data in a minimum vertical blank period between the previous frame data and the present frame data. The second over-driving data is generated according to the previous frame data and the present frame data in a maximum vertical blank period between the previous frame data and the present frame data of the first frame data.

In an exemplary embodiment, outputting the second image data may include using third over-driving data according to the previous frame data and the present frame data in a normal vertical blank period corresponding to a period between the minimum vertical blank period and the maximum vertical blank period.

According to an exemplary embodiment of the present inventive concept, a display apparatus includes a display panel and a display panel driving apparatus. The display panel includes a data line and a gate line. The display panel driving apparatus includes an over-driving part, a data driving part and a gate driving part. The over-driving part is configured to receive first image data, and to output second image data using first over-driving data and second over-driving data. The first over-driving data is generated according to previous frame data and present frame data in a minimum vertical blank period between the previous frame data and the present frame data of the first frame data. The second over-driving data is generated according to the previous frame data and the present frame data in a maximum vertical blank period between the previous frame data and the present frame data of the first frame data. The data driving part is configured to output a data signal based on the second image data to the data line of the display panel. The gate driving part is configured to output a gate signal to the gate line of the display panel.

According to the present inventive concept, although a frame rate is changed, over-driving is performed on first image data adaptively to a frame rate to output second image data. Thus, high display quality of the display apparatus may be achieved.

BRIEF DESCRIPTION OF THE DRAWINGS

The above and other features of the present inventive concept will become more apparent by describing in detail exemplary embodiments thereof with reference to the accompanying drawings, in which:

FIG. 3 is a tabular diagram illustrating a first grayscale value stored in a first look-up table of FIG. 2;

FIG. 4 is a tabular diagram illustrating a second grayscale value stored in a second look-up table of FIG. 2;

FIG. 8 is a tabular diagram illustrating a third grayscale value stored in a third look-up table of FIG. 7.

DETAILED DESCRIPTION

Hereinafter, the present inventive concept will be explained in detail with reference to the accompanying drawings.

Figure 1:
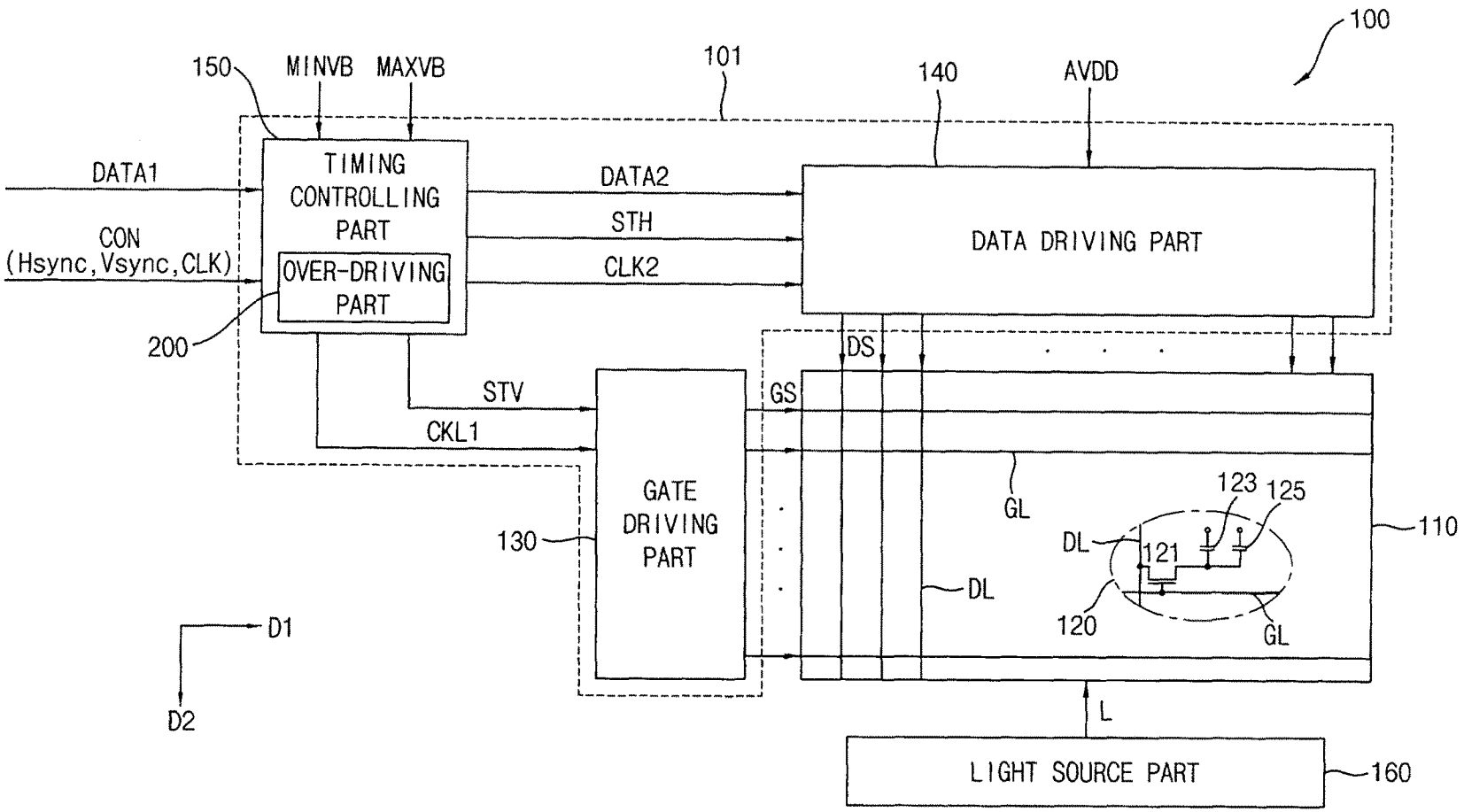
FIG. 1 is a schematic block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a display panel driving apparatus 101 connected to the display panel, and a light source part 160 connected to the display panel.

The display panel 110 receives a data signal DS based on first image data DATA1 and second image data DATA2 to display an image. For example, the first image data DATA1 and the second image data DATA2 may be plane image data. Alternatively, the first image data DATA1 and the second image data DATA2 may include left-eye image data and right-eye image data for displaying a three-dimensional stereoscopic image.

The display panel 110 includes gate lines GL, data lines DL and a plurality of pixels 120. The gate lines GL extend in a first direction D1 and are arranged in a second direction D2 substantially perpendicular to the first direction D1. The data lines DL extend in the second direction D2 and are arranged in the first direction D1. The first direction D1 may be parallel with a long side of the display panel 110, and the second direction D2 may be parallel with a short side of the display panel 110. Each of the pixels 120 may include a thin film transistor 121 electrically connected to the gate line GL and the data line DL, a liquid crystal capacitor 123 and a storage capacitor 125 connected to the thin film transistor 121. Thus, the display panel 110 may be a liquid crystal display panel, and the display apparatus 100 may be a liquid crystal display apparatus.

The display panel driving apparatus 101 includes a gate driving part 130, a data driving part 140 and a timing controlling part 150 connected to the gate driving part and the data driving part.

The gate driving part 130 generates a gate signal GS in response to a vertical start signal STV and a first clock signal CLK1 provided from the timing controlling part 150, and outputs the gate signal GS to the gate line GL.

The data driving part 140 outputs the data signals DS based on the second image data DATA2 to the data line DL in response to a horizontal start signal STH and a second clock signal CLK2 provided from the timing controlling part 150.

The timing controlling part 150 receives the first image data DATA1 and a control signal CON from outside. The control signal CON may include a horizontal synchronization signal Hsync, a vertical synchronization signal Vsync and a clock signal CLK. The timing controlling part 150 generates the horizontal start signal STH using the horizontal synchronization signal Hsync and outputs the horizontal start signal STH to the data driving part 140. In addition, the timing controlling part 150 generates the vertical start signal STV using the vertical synchronization signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140.

In addition, the timing controlling part 150 includes an over-driving part 200. The over-driving part 200 outputs the second image data DATA2 using a minimum vertical blank period MINVB and a maximum vertical blank period MAXVB of the first image data DATA1. The over-driving part 200 may perform over-driving on the first image data DATA1 in a Dynamic Capacitance Compensation (DCC) method to output the second image data DATA2.

The display apparatus 100 may further include a light source part 160 providing light L to the display panel 110. For example, the light source part 160 may include a Light Emitting Diode (LED).

Figure 2:
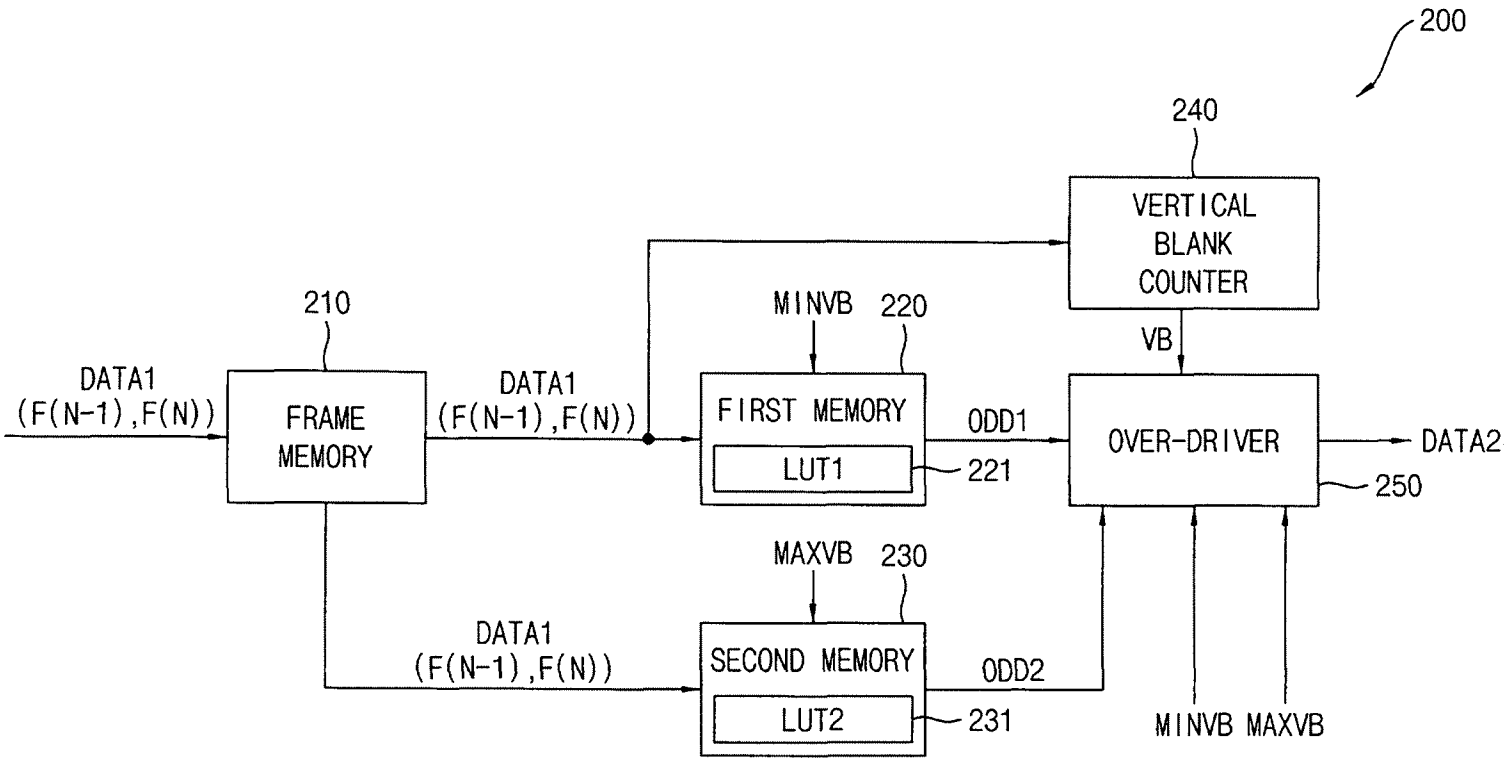
FIG. 2 is a schematic block diagram illustrating an over-driving part of FIG. 1.

FIG. 2 is a block diagram illustrating the over-driving part 200 of FIG. 1.

Referring to FIGS. 1 and 2, the over-driving part 200 includes a frame memory 210, a first memory 220, a second memory 230, a vertical blank counter 240 and an over-driver 250.

The frame memory 210 receives, stores and outputs previous frame data F(N−1) and present frame data F(N) of the first image data DATA1. For example, the frame memory 210 may be a Random Access Memory (RAM).

The first memory 220 stores and outputs first over-driving data ODD1 according to the previous frame data F(N−1) and the present frame data F(N) in the minimum vertical blank period MINVB between the previous frame data F(N−1) and the present frame data F(N) of the first image data DATA1. The first memory 220 may include a first look-up table 221 storing a first grayscale value according to the previous frame data F(N−1) and the present frame data F(N) in the minimum vertical blank period MINVB. For example, the first memory 220 may be a Read Only Memory (ROM).

The second memory 230 stores and outputs second over-driving data ODD2 according to the previous frame data F(N−1) and the present frame data F(N) in the maximum vertical blank period MAXVB between the previous frame data F(N−1) and the present frame data F(N) of the first image data DATA1. The second memory 230 may include a second look-up table 231 storing a second grayscale value according to the previous frame data F(N−1) and the present frame data F(N) in the maximum vertical blank period MAXVB. For example, the second memory 230 may be a Read Only Memory (ROM).

FIG. 3 is a diagram illustrating the first grayscale value stored in the first look-up table 221 of FIG. 2. FIG. 4 is a diagram illustrating the second grayscale value stored in the second look-up table 231 of FIG. 2.

Referring to FIGS. 1 to 4, the first grayscale value according to the previous frame data F(N−1) and the present frame data F(N) in the minimum vertical blank period MINVB is greater than the second grayscale value according to the previous frame data F(N−1) and the present frame data F(N) in the maximum vertical blank period MAXVB. For example, when the previous frame data F(N−1) has 0 grayscale value and the present frame data F(N) has 96 grayscale value, the first grayscale value of the first over-driving data ODD1 may be 206 grayscale value and the second grayscale value of the second over-driving data ODD2 may be 182 grayscale value.

The vertical blank counter 240 counts a vertical blank period VB between the previous frame data F(N−1) and the present frame data F(N).

The over-driver 250 outputs the second image data DATA2 using the first over-driving data ODD1 and the second over-driving data ODD2 according to the vertical blank period VB between the previous frame data F(N−1) and the present frame data F(N).

Specifically, when the vertical blank period VB corresponds to the minimum vertical blank period MINVB, the over-driver 250 outputs the second image data DATA2 using the first over-driving data ODD1. Thus, when the vertical blank period VB corresponds to the minimum vertical blank period MINVB, the over-driver 250 outputs the second image data DATA2 using a first grayscale value stored in the first look-up table 221. For example, when the previous frame data F(N−1) has 0 grayscale value, the present frame data F(N) has 96 grayscale value, and the vertical blank period VB corresponds to the minimum vertical blank period MINVB, the second image data DATA2 may have 206 grayscale value.

When the vertical blank period VB is less than the minimum vertical blank period MINVB, the over-driver 250 outputs the second image data DATA2 using the first over-driving data ODD1. Thus, when the vertical blank period VB is less than the minimum vertical blank period MINVB, the over-driver 250 outputs the second image data DATA2 using a first grayscale value stored in the first look-up table 221. For example, when the previous frame data F(N−1) has 0 grayscale value, the present frame data F(N) has 96 grayscale value, and the vertical blank period VB is less than the minimum vertical blank period MINVB, the second image data DATA2 may have 206 grayscale value.

Alternatively, when the vertical blank period VB is less than the minimum vertical blank period MINVB, the over-driver 250 may not perform an over-driving on the first image data DATA1. Thus, when the vertical blank period VB is less than the minimum vertical blank period MINVB, the over-driver 250 may output the first image data DATA1 as the second image data DATA2.

When the vertical blank period VB corresponds to the maximum vertical blank period MAXVB, the over-driver 250 outputs the second image data DATA2 using the second over-driving data ODD2. Thus, when the vertical blank period VB corresponds to the maximum vertical blank period MAXVB, the over-driver 250 outputs the second image data DATA2 using the second grayscale value stored in the second look-up table 231. For example, when the previous frame data F(N−1) has 0 grayscale value, the present frame data F(N) has 96 grayscale value, and the vertical blank period VB corresponds to the maximum vertical blank period MAXVB, the second image data DATA2 may have 182 grayscale value.

When the vertical blank period VB is greater than the maximum vertical blank period MAXVB, the over-driver 250 outputs the second image data DATA2 using the second over-driving data ODD2. Thus, when the vertical blank period VB is greater than the maximum vertical blank period MAXVB, the over-driver 250 outputs the second image data DATA2 using a second grayscale value stored in the second look-up table 231. For example, when the previous frame data F(N−1) has 0 grayscale value, the present frame data F(N) has 96 grayscale value, and the vertical blank period VB is greater than the maximum vertical blank period MAXVB, the second image data DATA2 may have 182 grayscale value.

Alternatively, when the vertical blank period VB is greater than the maximum vertical blank period MAXVB, the over-driver 250 may not perform an over-driving on the first image data DATA1. Thus, when the vertical blank period VB is greater than the maximum vertical blank period MAXVB, the over-driver 250 may output the first image data DATA1 as the second image data DATA2.

When the vertical blank period VB corresponds to a period between the minimum vertical blank period MINVB and the maximum vertical blank period MAXVB, the over-driver 250 outputs the second image data DATA2 using the first over-driving data ODD1 and the second over-driving data ODD2. Thus, when the vertical blank period VB corresponds to the period between the minimum vertical blank period MINVB and the maximum vertical blank period MAXVB, the over-driver 250 outputs the second image data DATA2 using the first grayscale value stored in the first look-up table 221 and the second grayscale value stored in the second look-up table 231.

The over-driver 250 outputs the second image data DATA2 using the first grayscale value and the second grayscale value in an interpolation method. The over-driver 250 may calculate the second image data DATA2 by Equation 1.

$$ODD1+((ODD2-ODD1)*(MINVB+VB)/MAXVB)) \quad \text{[Equation 1]}$$

(ODD1 is a first grayscale value of the first over-driving data, ODD2 is a second grayscale value of the second over-driving data, MINVB is the number of a line duration corresponding to the minimum vertical blank period, MAXVB is the number of a line duration corresponding to the maximum vertical blank period, and VB is the number of a line duration corresponding to the present vertical blank period.)

For example, when the previous frame data F(N−1) has 0 grayscale value, the present frame data F(N) has 96 grayscale value, the number of the line duration corresponding to the minimum vertical blank period MINVB is 12, the number of the line duration corresponding to the maximum vertical blank period MAXVB is 4211, and the number of the line duration corresponding to the vertical blank period VB is 160, the second image data DATA2 may have 183 grayscale value.

Figure 5:
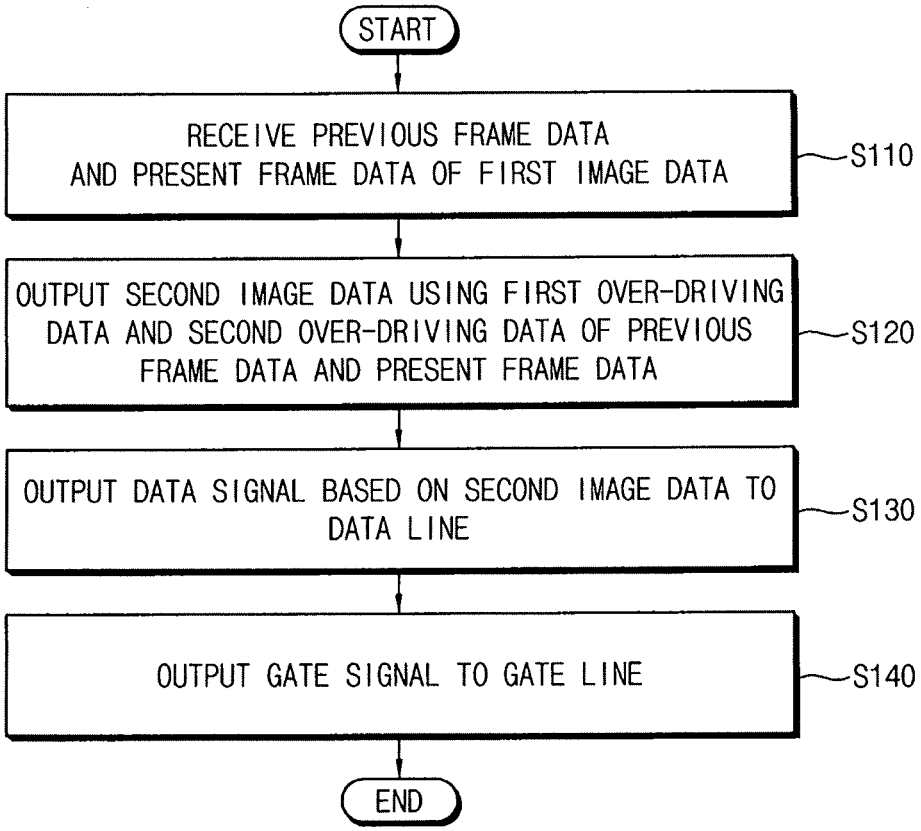
FIG. 5 is a flow chart diagram illustrating a method of driving a display panel using a display panel driving apparatus of FIG. 1.

FIG. 5 is a flow chart illustrating a method of driving a display panel using the display panel driving apparatus 101 of FIG I.

Referring to FIGS. 1, 2 and 5, the previous frame data F(N−1) and the present frame data F(N) of the first image data DATA1 are received (step S110). Specifically, the frame memory 210 of the over-driving part 200 receives, stores and outputs the previous frame data F(N−1) and the present frame data F(N) of the first image data DATA1.

The second image data DATA2 is output using the first over-driving data ODD1 and the second over-driving data ODD2 of the previous frame data F(N−1) and the present frame data F(N) (step S120). Specifically, the over-driver 250 of the over-driving part 200 outputs the second image data DATA2 using the first over-driving data ODD1 and the second over-driving data ODD2 according to the vertical blank period VB between the previous frame data F(N−1) and the present frame data F(N).

More specifically, when the vertical blank period VB corresponds to the minimum vertical blank period MINVB, the over-driver 250 outputs the second image data DATA2 using the first over-driving data ODD1. Thus, when the vertical blank period VB corresponds to the minimum vertical blank period MINVB, the over-driver 250 outputs the second image data DATA2 using the first grayscale value stored in the first look-up table 221.

When the vertical blank period VB is less than the minimum vertical blank period MINVB, the over-driver 250 outputs the second image data DATA2 using the first over-driving data ODD1. Thus, when the vertical blank period VB is less than the minimum vertical blank period MINVB, the over-driver 250 outputs the second image data DATA2 using the first grayscale value stored in the first look-up table 221.

Alternatively, when the vertical blank period VB is less than the minimum vertical blank period MINVB, the over-driver 250 may not perform an over-driving on the first image data DATA1. Thus, when the vertical blank period VB is less than the minimum vertical blank period MINVB, the over-driver 250 may output the first image data DATA1 as the second image data DATA2.

When the vertical blank period VB corresponds to the maximum vertical blank period MAXVB, the over-driver 250 outputs the second image data DATA2 using the second over-driving data ODD2. Thus, when the vertical blank period VB corresponds to the maximum vertical blank period MAXVB, the over-driver 250 outputs the second image data DATA2 using the second grayscale value stored in the second look-up table 231.

When the vertical blank period VB is greater than the maximum vertical blank period MAXVB, the over-driver 250 outputs the second image data DATA2 using the second over-driving data ODD2. Thus, when the vertical blank period VB is greater than the maximum vertical blank period MAXVB, the over-driver 250 outputs the second image data DATA2 using the second grayscale value stored in the second look-up table 231.

Alternatively, when the vertical blank period VB is greater than the maximum vertical blank period MAXVB, the over-driver 250 may not perform an over-driving on the first image data DATA1. Thus, when the vertical blank period VB is greater than the maximum vertical blank period MAXVB, the over-driver 250 may output the first image data DATA1 as the second image data DATA2.

When the vertical blank period VB corresponds to the period between the minimum vertical blank period MINVB and the maximum vertical blank period MAXVB, the over-driver 250 outputs the second image data DATA2 using the first over-driving data ODD1 and the second over-driving data ODD2. Thus, when the vertical blank period VB corresponds to the period between the minimum vertical blank period MINVB and the maximum vertical blank period MAXVB, the over-driver 250 outputs the second image data DATA2 using a first grayscale value stored in the first look-up table 221 and a second grayscale value stored in the second look-up table 231. The over-driver 250 outputs the second image data DATA2 using the first grayscale value and the second grayscale value in an interpolation method.

The data signal DS based on the second image data DATA2 is output to the data line DL (step S130). Specifically, the data driving part 140 outputs the data signals DS based on the second image data DATA2 to the data line DL in response to the horizontal start signal STH and the second clock signal CLK2 provided from the timing controlling part 150.

The gate signal GS is output to the gate line GL (step S140). Specifically, the gate driving part 130 generates the gate signal GS in response to the vertical start signal STV and the first clock signal CLK1 provided from the timing controlling part 150, and outputs the gate signal GS to the gate line GL.

In the present exemplary embodiment, the over-driving part 200 is in the timing controlling part 150, but is not limited thereto. For example, the over-driving part 200 may be disposed between the timing controlling part 150 and the data driving part 140.

According to the present exemplary embodiment, when the vertical blank period VB corresponds to the minimum vertical blank period MINVB, the over-driver 250 outputs the second image data DATA2 using the first grayscale value of the first over-driving data ODD1. In addition, when the vertical blank period VB corresponds to the maximum vertical blank period MAXVB, the over-driver 250 outputs the second image data DATA2 using the second grayscale value of the second over-driving data ODD2. In addition, when the vertical blank period VB corresponds to the period between the minimum vertical blank period MINVB and the maximum vertical blank period MAXVB, the over-driver 250 outputs the second image data DATA2 using the first grayscale value of the first over-driving data ODD1 and the second grayscale value of the second over-driving data ODD2 in an interpolation method. Therefore, a case may be prevented in which a data voltage of the second image data DATA2 is less than a target voltage because the vertical blank period VB is close to the minimum blank period MINVB and thus the vertical blank period VB is comparatively short. In addition, a case may be prevented in which the data voltage of the second image data DATA2 is greater than the target voltage because the vertical blank period VB is close to the maximum blank period MAXVB and thus the vertical blank period VB is comparatively long. Further, although a frame rate is changed, the second image data DATA2 may be output by performing an over-driving on the first image data DATA1 adaptively to the frame rate. Thus, high display quality of the display apparatus 100 may be achieved.

Figure 6:
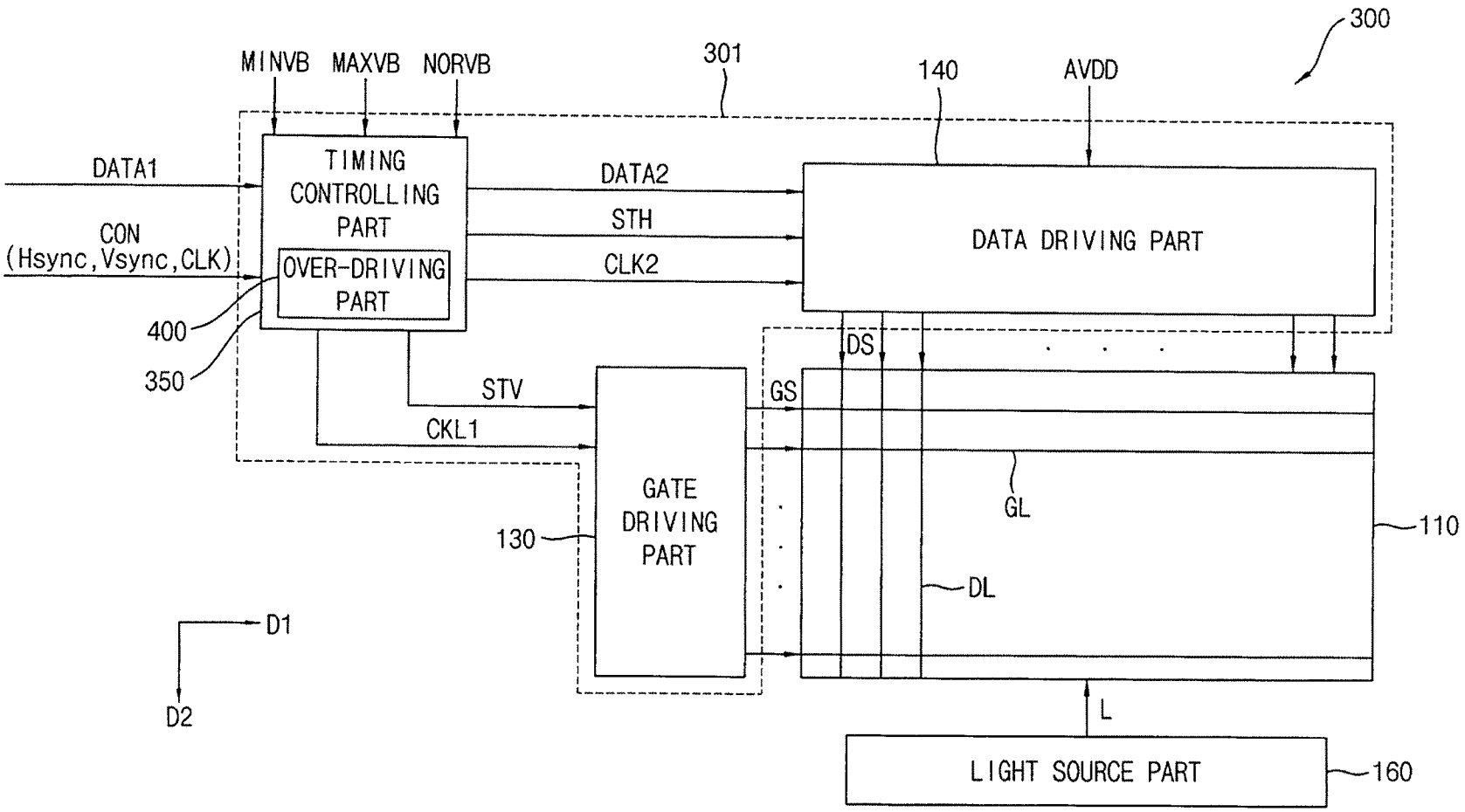
FIG. 6 is a schematic block diagram illustrating a display apparatus according to an exemplary embodiment of the present inventive concept.

FIG. 6 is a block diagram illustrating a display apparatus according to an exemplary embodiment of the present inventive concept.

The display apparatus 300 according to the present exemplary embodiment illustrated in FIG. 6 is substantially the same as the display apparatus 100 according to the previous exemplary embodiment illustrated in FIG. 1 except for a display panel driving apparatus 301 including a timing controlling part 350 and an over-driving part 400. Thus, the same reference numerals may be used to refer to same or like parts as those described for FIG. 1 and any further repetitive explanation concerning the above elements may be omitted.

Referring to FIG. 6, the display apparatus 300 according to the present exemplary embodiment includes the display panel 110 and the display panel driving apparatus 301.

The display panel driving apparatus 301 includes the gate driving part 130, the data driving part 140 and the timing controlling part 350.

The timing controlling part 350 receives the first image data DATA1 and the control signal CON from the outside. The control signal CON may include the horizontal synchronization signal Hsync, the vertical synchronization signal Vsync and the clock signal CLK. The timing controlling part 350 generates the horizontal start signal STH using the horizontal synchronization signal Hsync and outputs the horizontal start signal STH to the data driving part 140. In addition, the timing controlling part 350 generates the vertical start signal STV using the vertical synchronization signal Vsync and outputs the vertical start signal STV to the gate driving part 130. The timing controlling part 350 further generates the first clock signal CLK1 and the second clock signal CLK2 using the clock signal CLK, outputs the first clock signal CLK1 to the gate driving part 130, and outputs the second clock signal CLK2 to the data driving part 140.

The timing controlling part 350 may include the over-driving part 400. The over-driving part 400 outputs the second image data DATA2 using a minimum vertical blank period MINVB, a maximum vertical blank period MAXVB and a normal vertical blank period NORVB of the first image data DATA1. The over-driving part 400 may perform an over-driving on the first image data DATA1 in a Dynamic Capacitance Compensation (DCC) method to output the second image data DATA2.

Figure 7:
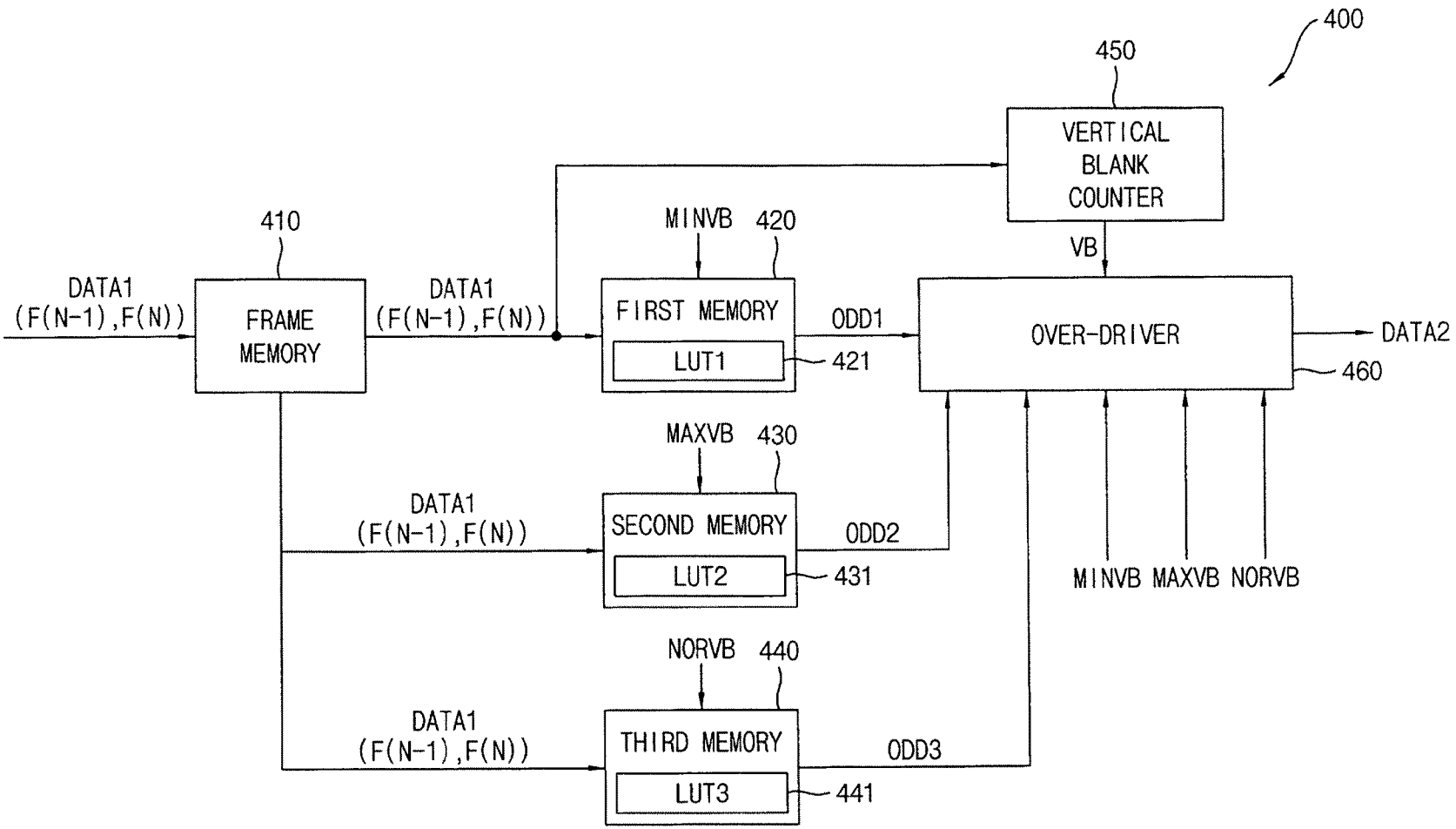
FIG. 7 is a schematic block diagram illustrating an over-driving part of FIG. 6.

FIG. 7 is a block diagram illustrating the over-driving part 400 of FIG. 6.

Referring to FIGS. 6 and 7, the over-driving part 400 includes a frame memory 410, a first memory 420 connected to the frame memory, a second memory 430 connected to the frame memory, a third memory 440 connected to the frame memory, a vertical blank counter 450 connected to the frame memory and an over-driver 460 connected to each of the vertical blank counter and first through third memories.

The frame memory 410 receives, stores and outputs previous frame data F(N−1) and present frame data F(N) of the first image data DATA1. For example, the frame memory 410 may be a Random Access Memory (RAM).

The first memory 420 stores and outputs first over-driving data ODD1 according to the previous frame data F(N−1) and the present frame data F(N) for the minimum vertical blank period MINVB between the previous frame data F(N−1) and the present frame data F(N) of the first image data DATA1. The first memory 420 may include a first look-up table 421 storing a first grayscale value according to the previous frame data F(N−1) and the present frame data F(N) for the minimum vertical blank period MINVB. For example, the first memory 420 may be a Read Only Memory (ROM).

The second memory 430 stores and outputs second over-driving data ODD2 according to the previous frame data F(N−1) and the present frame data F(N) for the maximum vertical blank period MAXVB between the previous frame data F(N−1) and the present frame data F(N) of the first image data DATA1. The second memory 430 may include a second look-up table 431 storing a second grayscale value according to the previous frame data F(N−1) and the present frame data F(N) for the maximum vertical blank period MAXVB. For example, the second memory 430 may be a Read Only Memory (ROM).

The third memory 440 stores and outputs third over-driving data ODD3 according to the previous frame data F(N−1) and the present frame data F(N) for the normal vertical blank period NORVB between the previous frame data F(N−1) and the present frame data F(N) of the first image data DATA1. The third memory 440 may include a third look-up table 441 storing a third grayscale value according to the previous frame data F(N−1) and the present frame data F(N) for the normal vertical blank period NORVB. For example, the third memory 440 may be a Read Only Memory (ROM). The normal vertical blank period NORVB may correspond to a frame rate having a frequency of about 60 Hz.

A diagram illustrating the first grayscale value stored in the first look-up table 421 may be substantially the same as the diagram illustrating the first grayscale value shown in FIG. 3, and a diagram illustrating the second grayscale value stored in the second look-up table 431 may be substantially the same as the diagram illustrating the second grayscale value shown in FIG. 4.

FIG. 8 is a diagram illustrating a third grayscale value stored in the third look-up table 441 of FIG. 7.

Referring to FIGS. 3, 4 and 8, a third grayscale value according to the previous frame data F(N−1) and the present frame data F(N) in the normal vertical blank period NORVB may have a value between the first grayscale value according to the previous frame data F(N−1) and the present frame data F(N) for the minimum vertical blank period MINVB and the second grayscale value according to the previous frame data F(N−1) and the present frame data F(N) for the maximum vertical blank period MAXVB. For example, when the previous frame data F(N−1) has 0 grayscale value and the present frame data F(N) has 96 grayscale value, the first grayscale value of the first over-driving data ODD1 may be 206 grayscale value, the second grayscale value of the second over-driving data ODD2 may be 182 grayscale value, and the third grayscale value of the third over-driving data ODD3 may be 194 grayscale value.

Referring to FIG. 7 again, the vertical blank counter 450 counts the vertical blank period VB between the previous frame data F(N−1) and the present frame data F(N). The blank counter may be configured to recognize, blank and/or ignore non-display data corresponding to the vertical blank period.

The over-driver 460 outputs the second image data DATA2 using the first over-driving data ODD1, the second over-driving data ODD2 and the third over-driving data ODD3 according to the vertical blank period VB between the previous frame data F(N−1) and the present frame data F(N).

Specifically, when the vertical blank period VB corresponds to the minimum vertical blank period MINVB, the over-driver 460 outputs the second image data DATA2 using the first over-driving data ODD1. Thus, when the vertical blank period VB corresponds to the minimum vertical blank period MINVB, the over-driver 460 outputs the second image data DATA2 using a first grayscale value stored in the first look-up table 421.

When the vertical blank period VB is less than the minimum vertical blank period MINVB, the over-driver 460 outputs the second image data DATA2 using the first over-driving data ODD1. Thus, when the vertical blank period VB is less than the minimum vertical blank period MINVB, the over-driver 460 outputs the second image data DATA2 using a first grayscale value stored in the first look-up table 421.

Alternatively, when the vertical blank period VB is less than the minimum vertical blank period MINVB, the over-driver 460 may not perform an over-driving on the first image data DATA1. Thus, when the vertical blank period VB is less than the minimum vertical blank period MINVB, the over-driver 460 may output the first image data DATA1 as the second image data DATA2.

When the vertical blank period VB corresponds to the maximum vertical blank period MAXVB, the over-driver 460 outputs the second image data DATA2 using the second over-driving data ODD2. Thus, when the vertical blank period VB corresponds to the maximum vertical blank period MAXVB, the over-driver 460 outputs the second image data DATA2 using a second grayscale value stored in the second look-up table 431.

When the vertical blank period VB is greater than the maximum vertical blank period MAXVB, the over-driver 460 outputs the second image data DATA2 using the second over-driving data ODD2. Thus, when the vertical blank period VB is greater than the maximum vertical blank period MAXVB, the over-driver 460 outputs the second image data DATA2 using a second grayscale value stored in the second look-up table 431.

Alternatively, when the vertical blank period VB is greater than the maximum vertical blank period MAXVB, the over-driver 460 may not perform an over-driving on the first image data DATA1. Thus, when the vertical blank period VB is greater than the maximum vertical blank period MAXVB, the over-driver 460 may output the first image data DATA1 as the second image data DATA2.

When the vertical blank period VB corresponds to a period between the minimum vertical blank period MINVB and the normal vertical blank period NORVB, the over-driver 460 outputs the second image data DATA2 using the first over-driving data ODD1 and the third over-driving data ODD3. Thus, when the vertical blank period VB corresponds to the period between the minimum vertical blank period MINVB and the normal vertical blank period NORVB, the over-driver 460 outputs the second image data DATA2 using a first grayscale value stored in the first look-up table 421 and a third grayscale value stored in the third look-up table 441.

The over-driver 460 outputs the second image data DATA2 using the first grayscale value and the third grayscale value in an interpolation method. The over-driver 460 may calculate the second image data DATA2 by Equation 2.

$$ODD1+((ODD3-ODD1)*(MINVB+VB)/NORVB)) \quad \text{[Equation 2]}$$

(ODD1 is the first grayscale value of the first over-driving data, ODD3 is the third grayscale value of the third over-driving data, MINVB is the number of a line duration corresponding to the minimum vertical blank period, NORVB is the number of a line duration corresponding to the normal vertical blank period, and VB is the number of a line duration corresponding to the vertical blank period.)

When the vertical blank period VB corresponds to a period between the normal vertical blank period NORVB and the maximum vertical blank period MAXVB, the over-driver 460 outputs the second image data DATA2 using the third over-driving data ODD3 and the second over-driving data ODD2. Thus, when the vertical blank period VB corresponds to the period between the normal vertical blank period NORVB and the maximum vertical blank period MAXVB, the over-driver 460 outputs the second image data DATA2 using a third grayscale value stored in the third look-up table 441 and a second grayscale value stored in the second look-up table 431.

The over-driver 460 outputs the second image data DATA2 using the third grayscale value and the second grayscale value in an interpolation method. The over-driver 460 may calculate the second image data DATA2 by Equation 3.

$$ODD3+((ODD2-ODD3)*(NORVB+VB)/MAXVB)) \quad \text{[Equation 3]}$$

(ODD3 is the third grayscale value of the third over-driving data, ODD2 is the second grayscale value of the second over-driving data, NORVB is the number of a line duration corresponding to the normal vertical blank period, MAXVB is the number of a line duration corresponding to the maximum vertical blank period, and VB is the number of a line duration corresponding to the vertical blank period.)

Figure 9:
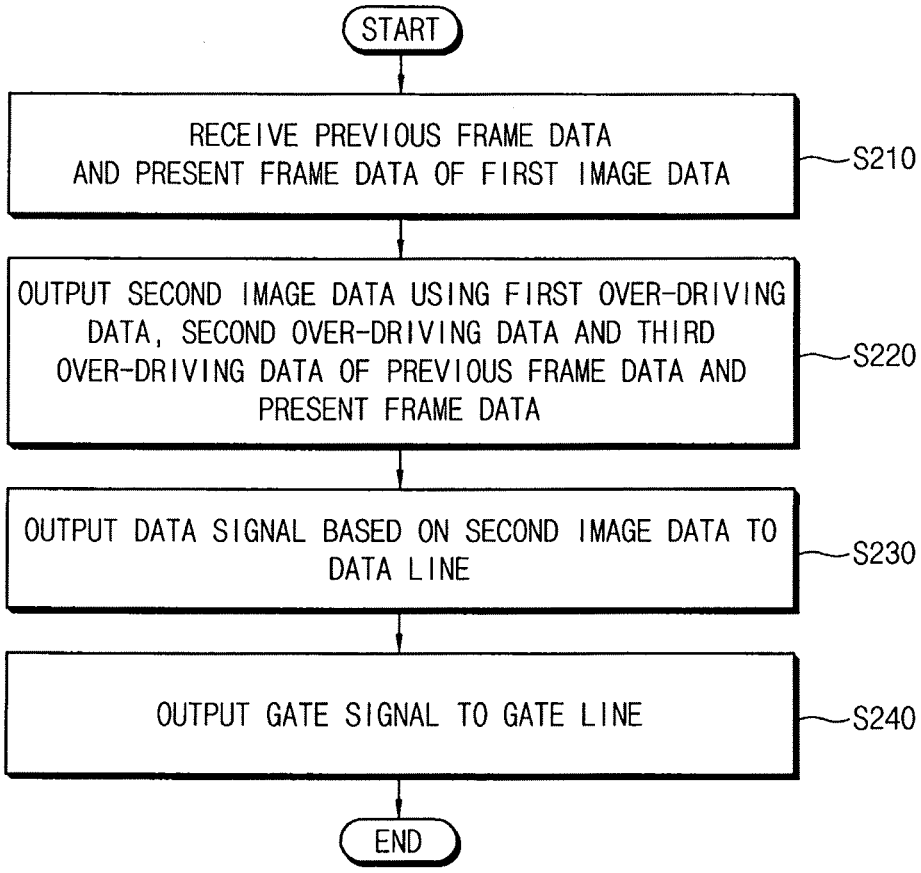
FIG. 9 is a flow chart diagram illustrating a method of driving a display panel using a display panel driving apparatus of FIG. 6.

FIG. 9 is a flow chart illustrating a method of driving a display panel using the display panel driving apparatus 301 of FIG. 6.

Referring to FIGS. 6, 7 and 9, the previous frame data F(N−1) and the present frame data F(N) of the first image data DATA1 are received (step S210). Specifically, the frame memory 410 of the over-driving part 400 receives, stores and outputs the previous frame data F(N−1) and the present frame data F(N) of the first image data DATA1.

The second image data DATA2 is output using the first over-driving data ODD1, the second over-driving data ODD2 and the third over-driving data ODD3 of the previous frame data F(N−1) and the present frame data F(N) (step S220). Specifically, the over-driver 460 of the over-driving part 400 outputs the second image data DATA2 using the first over-driving data ODD1, the second over-driving data ODD2 and the third over-driving data ODD3 according to the vertical blank period VB between the previous frame data F(N−1) and the present frame data F(N).

More specifically, when the vertical blank period VB corresponds to the minimum vertical blank period MINVB, the over-driver 460 outputs the second image data DATA2 using the first over-driving data ODD1. Thus, when the vertical blank period VB corresponds to the minimum vertical blank period MINVB, the over-driver 460 outputs the second image data DATA2 using the first grayscale value stored in the first look-up table 421.

When the vertical blank period VB is less than the minimum vertical blank period MINVB, the over-driver 460 outputs the second image data DATA2 using the first over-driving data ODD1. Thus, when the vertical blank period VB is less than the minimum vertical blank period MINVB, the over-driver 460 outputs the second image data DATA2 using the first grayscale value stored in the first look-up table 421.

Alternatively, when the vertical blank period VB is less than the minimum vertical blank period MINVB, the over-driver 460 may not perform an over-driving on the first image data DATA1. Thus, when the vertical blank period VB is less than the minimum vertical blank period MINVB, the over-driver 460 may output the first image data DATA1 as the second image data DATA2.

When the vertical blank period VB corresponds to the maximum vertical blank period MAXVB, the over-driver 460 outputs the second image data DATA2 using the second over-driving data ODD2. Thus, when the vertical blank period VB corresponds to the maximum vertical blank period MAXVB, the over-driver 460 outputs the second image data DATA2 using the second grayscale value stored in the second look-up table 431.

When the vertical blank period VB is greater than the maximum vertical blank period MAXVB, the over-driver 460 outputs the second image data DATA2 using the second over-driving data ODD2. Thus, when the vertical blank period VB is greater than the maximum vertical blank period MAXVB, the over-driver 460 outputs the second image data DATA2 using the second grayscale value stored in the second look-up table 431.

Alternatively, when the vertical blank period VB is greater than the maximum vertical blank period MAXVB, the over-driver 460 may not perform an over-driving on the first image data DATA1. Thus, when the vertical blank period VB is greater than the maximum vertical blank period MAXVB, the over-driver 460 may output the first image data DATA1 as the second image data DATA2.

When the vertical blank period VB corresponds to the period between the minimum vertical blank period MINVB and the normal vertical blank period NORVB, the over-driver 460 outputs the second image data DATA2 using the first over-driving data ODD1 and the third over-driving data ODD3. Thus, when the vertical blank period VB corresponds to the period between the minimum vertical blank period MINVB and the normal vertical blank period NORVB, the over-driver 460 outputs the second image data DATA2 using the first grayscale value stored in the first look-up table 421 and the third grayscale value stored in the third look-up table 441. The over-driver 460 outputs the second image data DATA2 using the first grayscale value and the third grayscale value in an interpolation method. For example, when the normal vertical blank period NORVB corresponds to a frame rate having a frequency of about 60 Hz, the period between the minimum vertical blank period MINVB and the normal vertical blank period NORVB may correspond to a frame rate having a frequency of 60 Hz or more.

When the vertical blank period VB corresponds to the period between the normal vertical blank period NORVB and the maximum vertical blank period MAXVB, the over-driver 460 outputs the second image data DATA2 using the third over-driving data ODD3 and the second over-driving data ODD2. Thus, when the vertical blank period VB corresponds to the period between the normal vertical blank period NORVB and the maximum vertical blank period MAXVB, the over-driver 460 outputs the second image data DATA2 using the third grayscale value stored in the third look-up table 441 and the second grayscale value stored in the second look-up table 431. The over-driver 460 outputs the second image data DATA2 using the third grayscale value and the second grayscale value in an interpolation method. For example, when the normal vertical blank period NORVB corresponds to the frame rate having the frequency of about 60 Hz, the period between the normal vertical blank period NORVB and the maximum vertical blank period MAXVB may correspond to a frame rate having a frequency of 60 Hz or less.

The data signal DS based on the second image data DATA2 is output to the data line DL (step S230). Specifically, the data driving part 140 outputs the data signals DS based on the second image data DATA2 to the data line DL in response to the horizontal start signal STH and the second clock signal CLK2 provided from the timing controlling part 350.

The gate signal GS is output to the gate line GL (step S240). Specifically, the gate driving part 130 generates the gate signal GS in response to the vertical start signal STV and the first clock signal CLK1 provided from the timing controlling part 350, and outputs the gate signal GS to the gate line GL.

In the present exemplary embodiment, the over-driving part 400 is in the timing controlling part 350, but is not limited thereto. For example, the over-driving part 400 may be disposed between the timing controlling part 350 and the data driving part 140.

According to the present exemplary embodiment, when the vertical blank period VB corresponds to the minimum vertical blank period MINVB, the over-driver 460 outputs the second image data DATA2 using the first grayscale value of the first over-driving data ODD1. In addition, when the vertical blank period VB corresponds to the maximum vertical blank period MAXVB, the over-driver 460 outputs the second image data DATA2 using the second grayscale value of the second over-driving data ODD2. In addition, when the vertical blank period VB corresponds to the period between the minimum vertical blank period MINVB and the normal vertical blank period NORVB, the over-driver 460 outputs the second image data DATA2 using the first over-driving data ODD1 and the third over-driving data ODD3 in an interpolation method. In addition, when the vertical blank period VB corresponds to the period between the normal vertical blank period NORVB and the maximum vertical blank period MAXVB, the over-driver 460 outputs the second image data DATA2 using the third over-driving data ODD3 and the second over-driving data ODD2 in an interpolation method. Therefore, a case may be prevented in which a data voltage of the second image data DATA2 is less than a target voltage because the vertical blank period VB is close to the minimum blank period MINVB and thus the vertical blank period VB is comparatively short. In addition, a case may be prevented in which the data voltage of the second image data DATA2 is greater than the target voltage because the vertical blank period VB is close to the maximum blank period MAXVB and thus the vertical blank period VB is comparatively long. Further, although a frame rate is changed, the second image data DATA2 may be output by performing an over-driving on the first image data DATA1 adaptively to the frame rate. Thus, high display quality of the display apparatus 300 may be achieved.

According to a display panel driving apparatus, a method of driving a display panel using the display panel driving apparatus, and a display apparatus having the display panel driving apparatus, although a frame rate may be changed, over-driving is performed on first image data adaptively to a frame rate to output second image data. Thus, high display quality of the display apparatus may be achieved. While the vertical blank period has been addressed herein for ease of explanation, which is traditionally the period between display of a bottom right pixel of a previous frame and a top left pixel of a present next frame, it shall be understood that the present inventive concept may be applied to horizontal or other blank periods, such as between a rightmost pixel of a previous horizontal line and a leftmost pixel of a present horizontal line, but is not limited thereto. Accordingly, all references to "vertical" in the preceding disclosure are merely exemplary.

The foregoing is illustrative of the present inventive concept and is not to be construed as limiting thereof. Although exemplary embodiments of the present inventive concept have been described, those of ordinary skill in the pertinent art will readily appreciate that many modifications are possible in the exemplary embodiments without materially departing from the novel teachings and advantages of the present inventive concept. Accordingly, all such modifications are intended to be included within the scope of the present inventive concept as defined in the appended claims. Therefore, it is to be understood that the foregoing is illustrative of the present inventive concept and is not to be construed as limited to the specific exemplary embodiments disclosed, and that modifications to the disclosed exemplary embodiments, as well as other embodiments, are intended to be included within the scope of the appended claims. The present inventive concept is defined by the following claims, with equivalents of the claims to be included therein.

What is claimed is:

1. A display panel driving apparatus comprising:

an over-driving circuit configured to receive first image data, and to output second image data using first over-driving data and second over-driving data, the first over-driving data being generated according to previous frame data and present frame data for a minimum blank period between the previous frame data and the present frame data of the first image data, the second over-driving data being generated according to the previous frame data and the present frame data for a maximum blank period between the previous frame data and the present frame data of the first image data;

a data driving circuit configured to output a data signal based on the second image data to a data line of a display panel; and a gate driving circuit including a gate signal generator configured to output a generated gate signal to a gate line of the display panel.

2. The display panel driving apparatus of claim 1, wherein the over-driving circuit comprises:

a first memory configured to store the first over-driving data according to the previous frame data and the present frame data for the minimum blank period; and a second memory configured to store the second over-driving data according to the previous frame data and the present frame data for the maximum blank period.

3. The display panel driving apparatus of claim 2, wherein the first memory comprises a first look-up table storing a first grayscale value according to the previous frame data and the present frame data for the minimum blank period, and the second memory comprises a second look-up table storing a second grayscale value according to the previous frame data and the present frame data for the maximum blank period.

4. The display panel driving apparatus of claim 3, wherein the first grayscale value according to the previous frame data and the present frame data for the minimum blank period is greater than the second grayscale value according to the previous frame data and the present frame data for the maximum blank period.

5. The display panel driving apparatus of claim 1, wherein the over-driving circuit further includes an over-driver configured to output the second image data using the first over-driving data and the second over-driving data according to a blank period between the previous frame data and the present frame data.

6. The display panel driving apparatus of claim 5, wherein, when the blank period is less than or equal to the minimum blank period, the over-driver outputs the second image data using the first over-driving data.

7. The display panel driving apparatus of claim 5, wherein, when the blank period is greater than or equal to the maximum blank period, the over-driver outputs the second image data using the second over-driving data.

8. The display panel driving apparatus of claim 5, wherein, when the blank period corresponds to a period between the minimum blank period and the maximum blank period, the over-driver outputs the second image data using the first over-driving data and the second over-driving data.

9. The display panel driving apparatus of claim 8, wherein the over-driver outputs the second image data as an interpolation between the first over-driving data and the second over-driving data in an interpolation method.

10. The display panel driving apparatus of claim 9, wherein the second image data is calculated by an equation 'ODD1+((ODD2−ODD1)*(MINVB+VB)/MAXVB))' where 'ODD1' is a first grayscale value of the first over-driving data, 'ODD2' is a second grayscale value of the second over-driving data, 'MINVB' is the duration number of a line corresponding to the minimum blank period, 'MAXVB' is the duration number of a line corresponding to the maximum blank period, and 'VB' is the duration number of a line corresponding to the blank period.

11. The display panel driving apparatus of claim 1, wherein the over-driving circuit outputs the second image data using third over-driving data for a normal blank period between the minimum blank period and the maximum blank period.

12. The display panel driving apparatus of claim 11, wherein the over-driving circuit further comprises a third memory storing the third over-driving data according to the previous frame data and the present frame data for the normal blank period.

13. The display panel driving apparatus of claim 12, wherein the third memory comprises a third look-up table storing a third grayscale value according to the previous frame data and the present frame data for the normal blank period.

14. The display panel driving apparatus of claim 13, wherein the over-driving circuit further comprises an over-driver outputting the second image data using the first over-driving data, the second over-driving data and the third over-driving data according to a blank period between the previous frame data and the present frame data.

15. The display panel driving apparatus of claim 14, wherein, when the blank period corresponds to the normal blank period, the over-driver outputs the second image data using the third over-driving data, when the blank period corresponds to a period between the minimum blank period and the normal blank period, the over-driver outputs the second image data using the first over-driving data and the third over-driving data, and when the blank period corresponds to a period between the maximum blank period and the normal blank period, the over-driver outputs the second image data using the second over-driving data and the third over-driving data.

16. The display panel driving apparatus of claim 1, wherein, when a blank period between the previous frame data and the present frame data is less than the minimum blank period, the over-driving circuit outputs the second image data using the first over-driving data, and when the blank period between the previous frame data and the present frame data is greater than the maximum blank period, the over-driving circuit outputs the second image data using the second over-driving data.

17. The display panel driving apparatus of claim 1, wherein, when a blank period between the previous frame data and the present frame data is less than the minimum blank period, the over-driving circuit outputs the first image data as the second image data, and when the blank period between the previous frame data and the present frame data is greater than the maximum blank period, the over-driving circuit outputs the first image data as the second image data.

18. The display panel driving apparatus of claim 1, further comprising a blank counter configured to determine a blank period between the previous frame data and the present frame data, wherein the blank counter may recognize, blank or ignore non-display data corresponding to the blank period.

19. A method of driving a display panel, the method comprising:

receiving previous frame data and present frame data of first image data;

outputting second image data using first over-driving data and second over-driving data, the first over-driving data being generated according to previous frame data and present frame data for a minimum blank period between the previous frame data and the present frame data, the second over-driving data being generated according to the previous frame data and the present frame data for a maximum blank period between the previous frame data and the present frame data of the first image data;

outputting a data signal based on the second image data to a data line of the display panel; and outputting a gate signal to a gate line of the display panel.

20. The method of claim 19, wherein the outputting the second image data comprises using third over-driving data according to the previous frame data and the present frame data for a normal blank period corresponding to a period between the minimum blank period and the maximum blank period.

* * * * *